US010760202B2

(12) United States Patent
Feng et al.

(10) Patent No.: US 10,760,202 B2
(45) Date of Patent: Sep. 1, 2020

(54) MARINE CLOTHES DRYER AND CONTROL METHOD THEREFOR

(71) Applicant: JIANGSU UNIVERSITY OF SCIENCE AND TECHNOLOGY, Jiangsu (CN)

(72) Inventors: Guozeng Feng, Jiangsu (CN); Dachuan Shi, Jiangsu (CN); Kaixuan Liu, Jiangsu (CN); Houju Pei, Jiangsu (CN); Yukun Wang, Jiangsu (CN)

(73) Assignee: JIANGSU UNIVERSITY OF SCIENCE AND TECHNOLOGY, Jiangsu (CN)

( * ) Notice: Subject to any disclaimer, the term of this patent is extended or adjusted under 35 U.S.C. 154(b) by 30 days.

(21) Appl. No.: 16/313,007

(22) PCT Filed: Jun. 19, 2017

(86) PCT No.: PCT/CN2017/088958
§ 371 (c)(1),
(2) Date: Dec. 22, 2018

(87) PCT Pub. No.: WO2018/001132
PCT Pub. Date: Jan. 4, 2018

(65) Prior Publication Data

US 2019/0226139 A1 Jul. 25, 2019

(30) Foreign Application Priority Data

Jun. 27, 2016 (CN) ..... 2016 1 0482688

(51) Int. Cl.
*D06F 58/10* (2006.01)
*D06F 58/30* (2020.01)
(Continued)

(52) U.S. Cl.
CPC ..... *D06F 58/10* (2013.01); *D06F 58/24* (2013.01); *D06F 58/26* (2013.01); *D06F 58/30* (2020.02);
(Continued)

(58) Field of Classification Search
CPC ..... D06F 58/10; D06F 58/24; D06F 58/28; D06F 58/26; D06F 58/30; D06F 2105/28; D06F 2105/24; D06F 2103/36
(Continued)

(56) References Cited

U.S. PATENT DOCUMENTS 4,112,590 A * 9/1978 Muller ..... D06F 25/00 34/596
4,757,699 A * 7/1988 Arreghini ..... D06F 25/00 219/400
(Continued)

FOREIGN PATENT DOCUMENTS

CN 102517857 6/2012
CN 203021820 6/2013
(Continued)

OTHER PUBLICATIONS

Yongwen Hu, "Design of Waste Gas Heat Source Clothes Drying Chamber of Ship Diesel Engine", Science & Technology Information, Sep. 26, 2013, pp. 142-143.
(Continued)

*Primary Examiner* — Stephen M Gravini
(74) *Attorney, Agent, or Firm* — JCIPRNET

(57) ABSTRACT

A marine clothes dryer includes a system for recovering waste heat from cooling water in a cylinder liner, a clothes drying system, and a regenerator system. The system for recovering waste heat from cooling water includes an engine cylinder liner, a water collector, and an air-water heat exchanger. The clothes drying system includes a drying
(Continued)

chamber, a circulating fan, a supply duct, and an exhaust duct. The regenerator system includes a gravity heat pipe exchanger with a condensing section and an evaporating section. A fresh air inlet is arranged at one side of the condensing section, and the other side thereof is in communication with one side of the air-water heat exchanger. The other side of the air-water heat exchanger is in communication with the drying chamber (15). One side of the evaporating section is provided with an exhaust port, and the other side thereof is in communication with the drying chamber.

8 Claims, 1 Drawing Sheet

(51) Int. Cl.

| | |
|---|---|
| ***D06F 58/24*** | (2006.01) |
| ***D06F 58/26*** | (2006.01) |
| ***D06F 103/36*** | (2020.01) |
| ***D06F 105/24*** | (2020.01) |
| ***D06F 105/28*** | (2020.01) |

(52) U.S. Cl.
CPC ..... *D06F 2103/36* (2020.02); *D06F 2105/24* (2020.02); *D06F 2105/28* (2020.02)

(58) Field of Classification Search
USPC ..... 34/513
See application file for complete search history.

(56) References Cited

U.S. PATENT DOCUMENTS

| | | | | |
|---|---|---|---|---|
| 6,151,795 | A | 11/2000 | Hoffman et al. | |
| 7,418,789 | B2 * | 9/2008 | Choi | D06F 58/02 34/380 |
| 8,272,090 | B2 * | 9/2012 | Park | D06F 35/006 8/149.3 |
| 8,418,509 | B2 * | 4/2013 | Yoo | D06F 25/00 68/3 R |
| 8,881,556 | B2 * | 11/2014 | Kawabata | D06F 58/30 68/208 |
| 8,984,767 | B2 * | 3/2015 | Grunert | D06F 58/22 34/138 |
| 10,087,569 | B2 * | 10/2018 | Bocchino | D06F 58/22 |
| 10,240,276 | B2 * | 3/2019 | Ryoo | D06F 58/206 |
| 10,253,448 | B2 * | 4/2019 | Bison | D06F 58/24 |
| 10,337,137 | B2 * | 7/2019 | Jung | D06F 58/24 |
| 2011/0302967 | A1 * | 12/2011 | Grunert | D06F 58/22 68/20 |
| 2019/0226139 | A1 * | 7/2019 | Feng | D06F 58/26 |
| 2019/0352193 | A1 * | 11/2019 | Lockwood | C02F 1/043 |

FOREIGN PATENT DOCUMENTS

| | | | | |
|---|---|---|---|---|
| CN | 103603175 | | 2/2014 | |
| CN | 103614891 | | 3/2014 | |
| CN | 105463808 | | 4/2016 | |
| CN | 106087357 | | 11/2016 | |
| JP | 2000176199 | | 6/2000 | |
| WO | WO-2018001132 | A1 * | 1/2018 | D06F 58/28 |

OTHER PUBLICATIONS

"International Search Report (Form PCT/ISA/210)", dated Sep. 14, 2017, with English translation thereof, pp. 1-6.

* cited by examiner

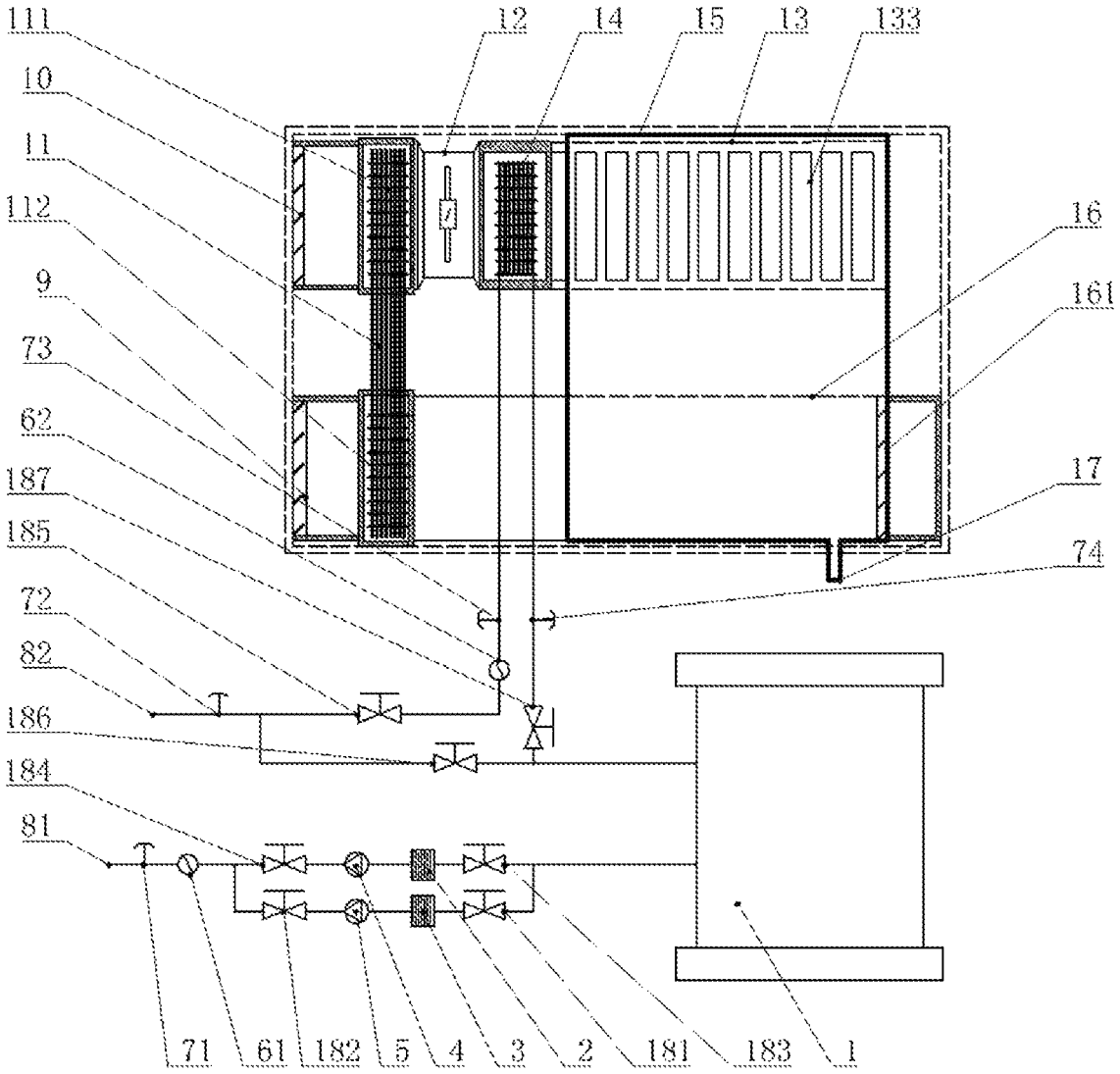
111
10
11
112
9
73
62
187
185
72
82
186
184
81
12
14
15
13
133
16
161
17
74
71
61
182
5
4
3
2
181
183
1

MARINE CLOTHES DRYER AND CONTROL METHOD THEREFOR

CROSS-REFERENCE TO RELATED APPLICATION

This is a 371 application of the International PCT application serial no. PCT/CN2017/088958, filed on Jun. 19, 2017, which claims the priority benefits of China Application No. 201610482688.0, filed on Jun. 27, 2016. The entirety of each of the above-mentioned patent applications is hereby incorporated by reference herein and made a part of this specification.

BACKGROUND

Field of the Invention

The present invention relates to a marine clothes dryer and a control method therefor, and in particular, to a marine clothes dryer that makes use of residual heat of a marine diesel engine and a control method therefor, and belongs to the technical field of marine devices.

Description of Related Art

Various light-tonnage ships sailing across different water areas have specific requirements on a clothes drying device due to light tonnage, limited fuel to be carried, poor environmental conditions, and significant humidity, and temperature variations. According to the way of heating, there are four main types of clothing drying systems that are most widely used at present: gas heating type, electric heating type, microwave heating type, and heat pump heating type. Although the four types of clothes drying systems are widely applied, they all have a lot of limitations when being applied in light-tonnage ships.

1. High power consumption. Most existing clothes dryers use fresh air systems, and exhausted air still contains-large amount of heat energy, causing serious waste of heat energy. Electric heating type clothes drying systems, microwave heating type clothes drying systems, and heat pump heating type clothes drying systems all use electric energy as a main energy source, which is not energy saving and environmentally friendly since light-tonnage ships are crowded and short of electricity.

2. High working temperature during a clothes drying process. The clothes drying temperature of the existing clothes dryer is usually above 60° C. and will cause damage to temperature-sensitive clothes, so the existing clothes dryer has a limited application range.

3. High noise in operation. The heat pump type clothes drying system includes moving parts such as a compressor. The noise is relatively large during operation, and the cost for maintenance at later stage is higher.

4. The gas heating type clothes drying system needs to be supplied with gas additionally and cannot be technically implemented on light-tonnage ships. As to the use of the microwave heating type clothes drying system, because metal components on the clothes are more easily influenced and damaged by microwave than fibers. As a result, their scope of application is very limited.

Only 35-50% of the total heat energy released by fuel burning in a diesel engine is converted to mechanical power, and the remaining heat energy becomes waste heat. An outlet temperature of cooling water in cylinder liner is usually in a range of 70-85° C., and heat brought by the cooling water occupies 15%-30% of the total heat released by burning fuel, and generally, such heat is not efficiently used. The article ((Design of Waste Gas Heat Source Clothes Drying Chamber of Ship Diesel Engine) in ((Science & Technology Information) with Issue No. 24, 2013) mentions a clothes drying chamber using a waste gas heat source of a marine diesel engine, that uses waste gas of the marine diesel engine as a heat source to heat air and uses hot air to dry wet clothes. However, the type of clothes dryer has following problems in actual use.

1. A temperature of the waste gas of the diesel engine is high and usually exceeds 150° C., and the waste gas will seriously cause damage to temperature-sensitive clothes when being directly used as the heat source of the clothes dryer.

2. When the waste gas of the diesel engine is directly used as the heat source, an exhaust pressure of the diesel engine may be easily reduced, thereby influencing normal operation of the diesel engine.

3. The temperature of the waste gas of the diesel engine is reduced when the waste gas is used as the heat source. When the temperature is reduced below about 150° C., acid corrosion may easily occur, and it is easy to cause fire once a heat exchange pipeline is broken.

In view of the above, compared with a clothes drying chamber using waste gas of ships, a clothes dryer using the cooling water in a cylinder liner to heat the air is more theoretically appropriate. Technically, it is more safe and reliable, and has advantages of less investment, small volume, energy saving, and environmentally friendly, and is especially suitable for small ships.

SUMMARY

An objective of the present invention is to provide a marine clothes dryer that makes use of residual heat of a diesel engine of a ship, so as to overcome deficiencies of the existing marine clothes dryer, that is, a heating system of the existing marine clothes dryer causes high power consumption, has moving parts such as a compressor, is very noisy during operation, and has a high cost for maintenance cost at later stage. The clothes dryer makes use of the residual heat from cooling water of a cylinder liner of a marine diesel engine as a heat source for heating air, thereby not only reducing power consumption of the marine clothes dryer, but also avoiding use of the moving parts such as the compressor, reducing noise, and facilitating maintenance.

To achieve the foregoing objective, the present invention uses following technical solution.

The marine clothes dryer includes a system for recovering waste heat from cooling water in a cylinder liner, a clothes drying system, and a regenerator system. The system for recovering waste heat from cooling water in a cylinder liner includes an engine cylinder liner, a water collector, and an air-water heat exchanger. An outlet of the water collector is connected to a water inlet of the engine cylinder liner by pipelines in which a third valve, a first filter, a first circulating water pump, a fourth valve, a first flowmeter, and a first thermometer are sequentially arranged. A water outlet of the engine cylinder liner is connected to an inlet of the air-water heat exchanger by pipelines in which a second thermometer, a fifth valve, and a second flowmeter are sequentially arranged. An outlet of the air-water heat exchanger is connected to an inlet of the water collector by pipelines in which a fourth thermometer and a seventh valve are sequentially arranged. A sixth valve is further arranged between an inlet end of the fifth valve and an outlet end of the seventh valve. The outlet of the water collector is connected to an inlet end of the first flowmeter by pipelines in which a first valve, a second filter, a second circulating pump, and a second valve are sequentially arranged. The clothes drying system includes a drying chamber with a door and a hanging rod, a circulating fan, an air supply duct, and an exhaust duct. The regenerator system includes a gravity heat pipe exchanger of which an upper half is a condensing section and a lower half is an evaporating section. A fresh air inlet is arranged at one side of the condensing section, and the other side of the condensing section is in communication with one side of the air-water heat exchanger through the circulating fan. The other side of the air-water heat exchanger is in communication with a hot air port arranged on the drying chamber through the supply duct. An exhaust port is arranged at one side of the evaporating section, and the other side of the evaporating section is in communication with a dewetting air port arranged on the drying chamber through the exhaust duct. A bottom portion of the drying chamber is further provided with a drain pipe.

Furthermore, the hot air port is a comb-shaped air port and is installed with a filter screen. The fresh air inlet, the exhaust port, and the dewetting air port are louvered air ports and are installed with a filter screen. The comb-shaped air port can facilitate uniform diffusion of hot air, and addition of the filter screens can prevent impurities from entering.

Furthermore, the drain pipe has an S-shaped trap, and an end of the drain pipe has a discharge valve, so as to prevent uncontrolled outflow of liquid water dripping from the clothes and condensed water.

Furthermore, the air-water heat exchanger is a fin-tube heat exchanger to enhance heat exchange effects.

Furthermore, the condensing section and the evaporating section of the gravity heat pipe exchanger are both installed with a helical fin, so as to enhance the heat exchange effects of the heat exchanger.

Preferably, the circulating fan is an axial flow fan.

Operation Principle:

The present invention further provides a control method for the marine clothes dryer.

When a clothes drying operation is required, open the door of the drying chamber, hang clothes to be dried on the hanging rod of the drying chamber, open the fifth valve and the seventh valve, close the sixth valve, close the first valve and the second valve while opening the third valve and the fourth valve or close the third valve and the fourth valve while opening the first valve and the second valve, turn on the circulating fan, so that under action of the first circulating water pump or the second circulating water pump, a circulating medium flows out of the outlet of the water collector, sequentially flows through the third valve, the first filter, the first circulating water pump and the fourth valve, or sequentially follows through the first valve, the second filter, the second circulating water pump, and the second valve, then flows through the first flowmeter and the first thermometer and into the water inlet of the engine cylinder liner, flows out of the water outlet of the engine cylinder liner, then sequentially flows through the second thermometer, the fifth valve, the second flowmeter, and the third thermometer to enter the air-water heat exchanger, so as to heat ambient air, and then flows back to the water collector through the seventh valve, and at the same time, under action of the circulating fan, fresh air enters the gravity heat pipe exchanger from the fresh air inlet, is pre-heated by passing through the condensing section of the gravity heat pipe exchanger, then enters the air-water heat exchanger to absorb heat to become a high-temperature dry air, then the high-temperature dry air enters the drying chamber from the hot air port through the supply duct, exchanges heat with the clothes in the drying chamber to become hot and humid air, the hot and humid air enters the exhaust duct through the dewetting air port, flows through the evaporating section of the gravity heat pipe exchanger, so that the waste heat is recovered, and finally is exhausted from the exhaust port with a large amount of moisture, and liquid water dripping from the clothes and condensed water flow to the drain pipe, and the discharge valve is opened to discharge the liquid water and the condensed water after the clothes drying operation is finished.

When the clothes drying operation is not required, open the sixth valve, close the fifth valve and the seventh valve, close the first valve and the second valve while opening the third valve and the fourth valve or close the third valve and the fourth valve while opening the first valve and the second valve, and turn off the circulating fan, so that under the action of the first circulating water pump or the second circulating water pump, the circulating medium flows out of the outlet of the water collector, sequentially flows through the third valve, the first filter, the first circulating water pump, and the fourth valve, or sequentially flows through the first valve, the second filter, the second circulating water pump, and the second valve, then flows through the first flowmeter and the first thermometer and into the water inlet of the engine cylinder liner, then sequentially flows out of the water outlet of the engine cylinder liner, then flows through the second thermometer and the sixth valve and flows back to the water collector, thereby finishing a cycle.

Furthermore, when the first circulating water pump is to be examined and repaired or has a failure, the third valve and the fourth valve are closed and the first valve and the second valve are opened.

When the second circulating water pump is to be examined and repaired or has a failure, the first valve and the second valve are closed and the third valve and the fourth valve are opened.

In the marine clothes dryer that uses the residual heat of the diesel engine of the ship, the cooling water of the engine cylinder liner is used as the heat source and exchanges the heat with the low-temperature water in the water collector. The temperature of the low-temperature water is increased after the exchange of the heat, the water flows through a heat coil to exchange the heat with lower-temperature gas, so as to become a-high-temperature dry air. In the modules of the clothes drying chamber, the high-temperature dry air is heated by the condensing section and the air-water heat exchanger of the gravity heat pipe exchanger, the high-temperature dry air enters the clothes drying chamber to perform heat and moisture exchange with wet clothes and then becomes high-temperature high-humidity air. Then, the heat in the high-temperature high-humidity air is recovered by the evaporating section of the gravity heat pipe exchanger, and then the air is exhausted. The cycle is repeated to transfer the moisture in the wet clothes to the air continuously, so as to realize clothes drying.

The present invention has following advantageous effects. The marine clothes dryer makes full use of the residual heat from the cooling water of the cylinder liner of the diesel engine of the ship. The structure is simple and the cost is low. While drying clothes, it is not necessary to specially provide energy, which reduces energy consumption. In addition, the use of the moving parts such as the compressor is eliminated, thereby effectively reducing noise and facilitating maintenance of the dryer at later stage.

BRIEF DESCRIPTION OF THE DRAWINGS

FIG. 1 is a schematic diagram of a construction principle according to an embodiment of the present invention.

DESCRIPTION OF THE EMBODIMENTS

The present invention is further described with reference to the accompanying drawing and the specific embodiments.

As shown in FIG. 1, a marine clothes dryer includes a system for recovering waste heat from cooling water in a cylinder liner, a clothes drying system, and a regenerator system. The system for recovering the waste heat from the cooling water in the cylinder liner includes an engine cylinder liner, a water collector 1, and an air-water heat exchanger 14. An outlet of the water collector 1 is connected to a water inlet 81 of the engine cylinder liner by pipelines in which a third valve 183, a first filter 2, a first circulating water pump 4, a fourth valve 184, a first flowmeter 61, and a first thermometer 71 are sequentially arranged. A water outlet 82 of the engine cylinder liner is connected to an inlet of the air-water heat exchanger 14 by pipelines in which a second thermometer 72, a fifth valve 185, and a second flowmeter 62 are sequentially arranged. An outlet of the air-water heat exchanger 14 is connected to an inlet of the water collector 1 by pipelines in which a fourth thermometer 74 and a seventh valve 187 are sequentially arranged. A sixth valve 186 is further arranged between an inlet end of the fifth valve 185 and an outlet end of the seventh valve 187. The outlet of the water collector 1 is connected to an inlet end of the first flowmeter 61 by pipelines in which a first valve 181, a second filter 3, a second circulating pump 5, and a second valve 182 are connected sequentially. The clothes drying system includes a drying chamber 15 with a door and a hanging rod, a circulating fan 12, a supply duct 13, and an exhaust duct 16. The regenerator system includes a gravity heat pipe exchanger 11 in which an upper half of the gravity heat pipe exchanger is a condensing section 111 and a lower half of the gravity heat pipe exchanger is an evaporating section 112. A fresh air inlet 10 is arranged at one side of the condensing section 111, and the other side of the condensing section 111 is in communication with one side of the air-water heat exchanger 14 by means of the circulating fan 12. The other side of the air-water heat exchanger 14 is in communication with a hot air port 133 arranged on the drying chamber 15 by means of the supply duct 13. An exhaust port 9 is arranged at one side of the evaporating section 112, and the other side of the evaporating section 112 is in communication with a dewetting air port 161 arranged on the drying chamber 15 by means of the exhaust duct 16. A bottom portion of the drying chamber 15 is further provided with a drain pipe 17.

The hot air port 133 is a comb-shaped air port and is installed with a filter screen, and the fresh air inlet 10, the exhaust port 9, and the dewetting air port 161 are louvered air ports and are installed with a filter screen.

The drain pipe 17 has an S-shaped trap (not shown in the FIGURE), and an end of the drain pipe 17 has a discharge valve (not shown in the FIGURE).

The air-water heat exchanger 14 is a fin-tube heat exchanger.

The condensing section 111 and the evaporating section 112 of the gravity heat pipe exchanger 11 are both installed with a helical fin.

The circulating fan 12 is an axial flow fan.

Control Method:

The present invention further provides a control method for the marine clothes dryer.

When a clothes drying operation is required, the door of the drying chamber 15 is opened, and clothes to be dried is hung on the hanging rod of the drying chamber 15. The fifth valve 185 and the seventh valve 187 are opened, the sixth valve 186 is closed, the first valve 181 and the second valve 182 are closed while the third valve 183 and the fourth valve 184 are opened or the third valve 183 and the fourth valve 184 are closed while the first valve 181 and the second valve 182 are opened. The circulating fan 12 is turned on, so that under action of the first circulating water pump 4 or the second circulating water pump 5, a circulating medium flows out of the outlet of the water collector 1, sequentially flows through the third valve 183, the first filter 2, the first circulating water pump 4 and the fourth valve 184, or sequentially flows through the first valve 181, the second filter 3, the second circulating water pump 5, and the second valve 182, then flows through the first flowmeter 61 and the first thermometer 71 and into the water inlet 81 of the engine cylinder liner, flows out of the water outlet 82 of the engine cylinder liner, then sequentially flows through the second thermometer 72, the fifth valve 185, the second flowmeter 62, and the third thermometer 73 to enter the air-water heat exchanger 14, so as to heat ambient air, and then flows back to the water collector 1 through the seventh valve 187. At the same time, under action of the circulating fan 12, fresh air enters the gravity heat pipe exchanger from the fresh air inlet 10, passes through the condensing section 111 of the gravity heat pipe exchanger 11 to be pre-heated, then enters the air-water heat exchanger 14 to absorb heat to become a high-temperature dry air. Then the high-temperature dry air enters the drying chamber 15 from the hot air port 133 through the supply duct 13, exchanges heat with the clothes in the drying chamber 15 to become hot and humid air. The hot and humid air enters the exhaust duct 16 through the dewetting air port 161, flows through the evaporating section 112 of the gravity heat pipe exchanger 11, so that the waste heat is recovered, and finally is exhausted from the exhaust port 9 with a large amount of moisture. Liquid water dripping from the clothes and condensed water flow to the drain pipe 17. Finally, the discharge valve is opened to discharge the liquid water and the condensed water after the clothes drying operation is finished.

When the clothes drying operation is not required, the sixth valve 186 is opened, and the fifth valve 185 and the seventh valve 187 are closed. The first valve 181 and the second valve 182 are closed while the third valve 183 and the fourth valve 184 are opened, or the third valve 183 and the fourth valve 184 are closed while the first valve 181 and the second valve 182 are opened. The circulating fan 12 is turned off, so that under the action of the first circulating water pump 4 or the second circulating water pump 5, the circulating medium flows out of the outlet of the water collector 1, sequentially flows through the third valve 183, the first filter 2, the first circulating water pump 4, and the fourth valve 184, or sequentially flows through the first valve 181, the second filter 3, the second circulating water pump 5, and the second valve 182, then flows through the first flowmeter 61 and the first thermometer 71 and into the water inlet 81 of the engine cylinder liner, then flows out of the water outlet 82 of the engine cylinder liner, then flows through the second thermometer 72 and the sixth valve 186 sequentially and flows back to the water collector 1, thereby finishing a cycle.

When the first circulating water pump 4 is to be examined and repaired or has a failure, the third valve 183 and the fourth valve 184 are closed and the first valve 181 and the second valve 182 are opened.

When the second circulating water pump 5 is to be examined and repaired or has a failure, the first valve 181 and the second valve 182 are closed and the third valve 183 and the fourth valve 184 are opened.

In addition to the foregoing embodiment, the present invention may have other implementations, and all technical solutions obtained by equivalent replacements or changes fall in the scope claimed by the present invention.

What is claimed is:

1. A marine clothes dryer, comprising: a system for recovering waste heat from cooling water in a cylinder liner, a clothes drying system, and a regenerator system, wherein the system for recovering the waste heat from the cooling water in the cylinder liner comprises an engine cylinder liner, a water collector, and an air-water heat exchanger, an outlet of the water collector is connected to a water inlet of the engine cylinder liner by pipelines in which a third valve, a first filter, a first circulating water pump, a fourth valve, a first flowmeter, and a first thermometer are sequentially arranged, a water outlet of the engine cylinder liner is connected to an inlet of the air-water heat exchanger by pipelines in which a second thermometer, a fifth valve and a second flowmeter are sequentially arranged, an outlet of the air-water heat exchanger is connected to an inlet of the water collector by pipelines in which a fourth thermometer, and a seventh valve are sequentially arranged, a sixth valve is arranged between an inlet end of the fifth valve and an outlet end of the seventh valve, the outlet of the water collector is connected to an inlet end of the first flowmeter by pipelines in which a first valve, a second filter, a second circulating water pump, and a second valve are sequentially arranged; the clothes drying system comprises a drying chamber having a door and a hanging rod, a circulating fan, a supply duct, and an exhaust duct, the regenerator system comprises a gravity heat pipe exchanger in which an upper half of the gravity heat pipe exchanger is a condensing section and a lower half of the gravity heat pipe exchanger is an evaporating section, a fresh air inlet is arranged at one side of the condensing section, and another side of the condensing section is in communication with one side of the air-water heat exchanger through the circulating fan, another side of the air-water heat exchanger is in communication with a hot air port provided on the drying chamber through the supply duct, an exhaust port is provided at one side of the evaporating section, and another side of the evaporating section is in communication with a dewetting air port provided on the drying chamber through the exhaust duct, and a bottom portion of the drying chamber is provided with a drain pipe.

2. The marine clothes dryer according to claim 1, wherein the hot air port is a comb-shaped air port and is installed with a filter screen, and the fresh air inlet, the exhaust port, and the dewetting air port are louvered air ports and are respectively installed with a filter screen.

3. The marine clothes dryer according to claim 1, wherein the drain pipe has an S-shaped trap, and an end of the drain pipe has a discharge valve.

4. The marine clothes dryer according to claim 1, wherein the air-water heat exchanger is a fin-tube heat exchanger.

5. The marine clothes dryer according to claim 1, wherein the condensing section and the evaporating section of the gravity heat pipe exchanger are both installed with a helical fin.

6. The marine clothes dryer according to claim 1, wherein the circulating fan is an axial flow fan.

7. A control method for a marine clothes dryer, the marine clothes dryer including a system for recovering waste heat from cooling water in a cylinder liner, a clothes drying system, and a regenerator system, wherein the system for recovering the waste heat from the cooling water in the cylinder liner comprises an engine cylinder liner, a water collector, and an air-water heat exchanger, an outlet of the water collector is connected to a water inlet of the engine cylinder liner by pipelines in which a third valve, a first filter, a first circulating water pump, a fourth valve, a first flowmeter, and a first thermometer are sequentially arranged, a water outlet of the engine cylinder liner is connected to an inlet of the air-water heat exchanger by pipelines in which a second thermometer, a fifth valve and a second flowmeter are sequentially arranged, an outlet of the air-water heat exchanger is connected to an inlet of the water collector by pipelines in which a fourth thermometer, and a seventh valve are sequentially arranged, a sixth valve is arranged between an inlet end of the fifth valve and an outlet end of the seventh valve, the outlet of the water collector is connected to an inlet end of the first flowmeter by pipelines in which a first valve, a second filter, a second circulating water pump, and a second valve are sequentially arranged; the clothes drying system comprises a drying chamber having a door and a hanging rod, a circulating fan, a supply duct, and an exhaust duct, the regenerator system comprises a gravity heat pipe exchanger in which an upper half of the gravity heat pipe exchanger is a condensing section and a lower half of the gravity heat pipe exchanger is an evaporating section, a fresh air inlet is arranged at one side of the condensing section, and another side of the condensing section is in communication with one side of the air-water heat exchanger through the circulating fan, another side of the air-water heat exchanger is in communication with a hot air port provided on the drying chamber through the supply duct, an exhaust port is provided at one side of the evaporating section, and another side of the evaporating section is in communication with a dewetting air port provided on the drying chamber through the exhaust duct, and a bottom portion of the drying chamber is provided with a drain pipe, the control method comprising following specific steps:

when a clothes drying operation is to be performed, open the door of the drying chamber, hang clothes to be dried on the hanging rod of the drying chamber, open the fifth valve and the seventh valve, close the sixth valve, close the first valve and the second valve while opening the third valve and the fourth valve or close the third valve and the fourth valve while opening the first valve and the second valve, turn on the circulating fan, so that under action of the first circulating water pump or the second circulating water pump, a circulating medium flows out of the outlet of the water collector, sequentially flows through the third valve, the first filter, the first circulating water pump and the fourth valve, or sequentially flows through the first valve, the second filter, the second circulating water pump, and the second valve, then flows through the first flowmeter and the first thermometer and into the water inlet of the engine cylinder liner, flows out of the water outlet of the engine cylinder liner, then sequentially flows through the second thermometer, the fifth valve, the second flowmeter, and the third thermometer to enter the air-water heat exchanger, so as to heat ambient air, and then flows back to the water collector through the seventh valve, and at the same time, under action of the circulating fan, fresh air enters the gravity heat pipe exchanger from the fresh air inlet, is pre-heated by passing through the condensing section of the gravity heat pipe exchanger, then enters the air-water heat exchanger to absorb heat to become high-temperature dry air, then the high-temperature dry air enters the drying chamber from the hot air port through the supply duct, exchanges heat with the clothes in the drying chamber to become hot and humid air, the hot and humid air enters the exhaust duct through the dewetting air port, flows through the evaporating section of the gravity heat pipe exchanger for recovering the waste heat, and finally is exhausted from the exhaust port with a large amount of moisture, and liquid water dripping from the clothes and condensed water flow to the drain pipe, and a discharge valve is opened to discharge the liquid water and the condensed water after the clothes drying operation is finished; and when the clothes drying operation is not to be performed, open the sixth valve, close the fifth valve and the seventh valve, close the first valve and the second valve while opening the third valve and the fourth valve or close the third valve and the fourth valve while opening the first valve and the second valve, and turn off the circulating fan, so that under the action of the first circulating water pump or the second circulating water pump, the circulating medium flows out of the outlet of the water collector, sequentially flows through the third valve, the first filter, the first circulating water pump, and the fourth valve, or sequentially flows through the first valve, the second filter, the second circulating water pump, and the second valve, then flows through the first flowmeter and the first thermometer and into the water inlet of the engine cylinder liner, then flows out of the water outlet of the engine cylinder liner, then sequentially flows through the second thermometer and the sixth valve and flows back to the water collector, thereby finishing a cycle.

8. The control method for the marine clothes dryer according to claim 7, wherein:

when the first circulating water pump is to be examined and repaired or has a failure, the third valve and the fourth valve are closed and the first valve and the second valve are opened; and when the second circulating water pump is to be examined and repaired or has a failure, the first valve and the second valve are closed and the third valve and the fourth valve are opened.

* * * * *